US008565454B2

(12) United States Patent
Kelloniemi et al.

(10) Patent No.: US 8,565,454 B2
(45) Date of Patent: Oct. 22, 2013

(54) DIRECTING SOUND FIELD OF ACTUATOR

(75) Inventors: Antti Kelloniemi, Helsinki (FI); Erkki Honkakoski, Sastamala (FI); Pasi Peltola, Tampere (FI)

(73) Assignee: Panphonics Oy, Espoo (FI)

( * ) Notice: Subject to any disclaimer, the term of this patent is extended or adjusted under 35 U.S.C. 154(b) by 247 days.

(21) Appl. No.: 12/934,737

(22) PCT Filed: Apr. 15, 2009

(86) PCT No.: PCT/FI2009/050282

§ 371 (c)(1),
(2), (4) Date: Sep. 27, 2010

(87) PCT Pub. No.: WO2009/127787

PCT Pub. Date: Oct. 22, 2009

(65) Prior Publication Data

US 2011/0019845 A1 Jan. 27, 2011

(30) Foreign Application Priority Data

Apr. 18, 2008 (FI) ..... 20085333

(51) Int. Cl.
*H04R 25/00* (2006.01)

(52) U.S. Cl.
USPC ..... 381/191; 381/190

(58) Field of Classification Search
USPC ..... 381/191, 173, 190; 700/94
See application file for complete search history.

(56) References Cited

U.S. PATENT DOCUMENTS

| | | | | |
|---|---|---|---|---|
| 3,135,838 A | | 6/1964 | Wright | |
| 3,668,336 A | | 6/1972 | Wright | |
| 3,773,976 A | | 11/1973 | Beveridge | |
| 3,773,984 A | | 11/1973 | Walker | |
| 3,892,927 A | | 7/1975 | Lindenberg | |
| 3,935,397 A | | 1/1976 | West | |
| 4,338,489 A | | 7/1982 | Gorike | |
| 4,533,794 A | * | 8/1985 | Beveridge | 381/174 |
| 4,703,509 A | * | 10/1987 | Kanchev | 381/191 |
| 5,297,011 A | * | 3/1994 | Triunfol | 362/147 |
| 6,785,393 B2 | * | 8/2004 | Lipponen et al. | 381/191 |
| 2002/0080984 A1 | * | 6/2002 | Croft et al. | 381/191 |

FOREIGN PATENT DOCUMENTS

| | | |
|---|---|---|
| CA | 1200888 A1 | 2/1986 |
| EP | 0258912 | 3/1988 |
| GB | 838022 A | 6/1960 |

(Continued)

OTHER PUBLICATIONS

International Search Report and Written Opinion for corresponding International Application No. PCT/FI2009/050282, dated Jul. 14, 2009.

(Continued)

*Primary Examiner* — Fan Tsang
*Assistant Examiner* — Eugene Zhao
(74) *Attorney, Agent, or Firm* — Marshall, Gerstein & Borun LLP

(57) ABSTRACT

The invention relates to a plate-like electrostatic actuator which comprises at least one plate-like stator with an electrode formed on its surface and at least one moving diaphragm, and in which a signal is transmitted to the electrode along a signal line. In the solution of the invention, the delay directing the sound field of the actuator is formed at least partly of an RC circuit composed of components of the actuator.

12 Claims, 2 Drawing Sheets

(56) References Cited

FOREIGN PATENT DOCUMENTS

Figure 1:
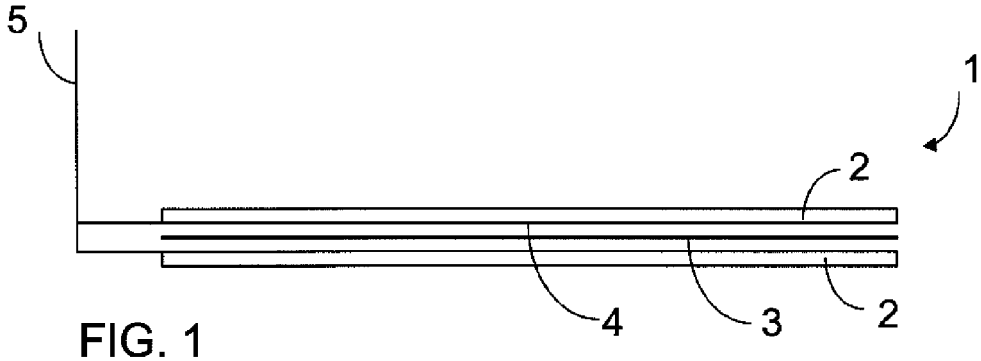

| | | | | |
|---|---|---|---|---|
| GB | 1059481 | A | | 2/1967 |
| GB | 1059481 | A | * | 2/1967 |
| GB | 1228775 | A | | 4/1971 |
| JP | 58131900 | | | 8/1983 |
| JP | 2265400 | A | | 10/1990 |
| JP | 2003116851 | A | | 4/2003 |
| JP | 2008092183 | A | | 4/2008 |

OTHER PUBLICATIONS

Supplementary European Search Report for European application No. 09733431, dated Jul. 5, 2011.

Office Action from corresponding Finnish Application No. FI20085333 (Jun. 26, 2009).

Office Action from corresponding Japanese application No. 2011-504494, dated May 21, 2013.

* cited by examiner

DIRECTING SOUND FIELD OF ACTUATOR

CROSS-REFERENCE TO RELATED APPLICATIONS

This is the U.S. national phase of International Application No. PCT/FI2009/050282, filed Apr. 15, 2009, which claims the benefit of Finnish Patent Application No. FI20085333, filed Apr. 18, 2008, the entire disclosures of which are hereby incorporated herein by reference.

BACKGROUND OF THE INVENTION

The invention relates to a plate-like electrostatic actuator which comprises at least one plate-like stator with an electrode formed on its surface and at least one moving diaphragm, and in which a signal is transmitted to the electrode along a signal line.

The invention further relates to a method for directing the sound field of a plate-like electrostatic actuator which comprises at least one plate-like stator with an electrode formed on its surface and at least one moving diaphragm, and in which a signal is transmitted to the electrode along a signal line.

Today, the directing of a radiation sound field is typically implemented by forming several sound sources and feeding a signal to each sound source by using a different delay and/or signal amplitude. The delay and frequency filtration of the signal is established by using either a constant-value or adjustable RC circuit, or alternatively by multi-channel analogue or digital signal processing. The use of several sound sources requires several delay circuits, and it is possibly necessary to use several amplification channels. Therefore, the system becomes complex and the number of required components large.

Publication U.S. Pat. No. 4,338,489 discloses a structure used mainly in headsets for directing the radiation field of an actuator. In this solution, the sound-producing diaphragm is divided into several sections and a signal directed to the different sections is delayed differently. Publication JP 2 265 400 discloses a solution for adjusting the directivity of a loudspeaker. In this solution, a large number of vibrators are arranged on the same plane, and the signal coming to each vibrator is directed through its own delay device. Directivity is provided by adjusting the phase delay angles of the delay devices appropriately. Both solutions do, however, require separate delay devices or circuits for forming the delay for different parts of the diaphragm or separate vibrators, which increases the number of components and the complexity of the system.

BRIEF DESCRIPTION OF THE INVENTION

It is an object of the present invention to provide a novel and improved way of directing the radiation sound field of an actuator.

The method of the invention is characterised by providing directivity by forming the delay directing the sound field with an RC circuit that is at least partly composed of components of the actuator.

The device of the invention is characterised in that the delay directing the sound field is at least partly formed of an RC circuit composed of components of the actuator.

The idea of the invention is that, instead of several sound sources and several delay circuits and amplification channels needed to control them, the plate-like electrostatic actuator itself is at least partly used. In the solution of the invention, the directivity of the sound field is based on forming the delay directing the sound field with an RC circuit that is at least partly composed of components of the electrostatic actuator. According to an embodiment, the electrostatic actuator itself serves as the capacitor of the RC circuit, which is possible, because the stators are so close to each other, preferably at less than 0.5 mm apart, that the capacitance of the electrostatic actuator is quite high. Further, according to an embodiment, the resistor of the RC circuit is in turn formed by making the electrode, that is, the surface of the stator, of a somewhat resistive material.

The invention provides the advantage that the number of required components decreases and both the structure and control become significantly simpler in comparison with when the corresponding directing is implemented using the prior art. This is achieved, because separate resistors, for instance, are not necessarily needed and the structure as such is at least partly used as the components.

Another advantage of the solution of the invention is that, with it, it is possible to achieve good directivity and plane waveform, whereby for instance the reflection of sound from walls, ceilings, and other corresponding elements can be efficiently prevented or utilised as necessary.

Yet another advantage of the invention is the optimisation of the listening area and the number of loudspeakers, since the same technology is capable of producing very different, exactly specified sound fields according to application from very narrow to very wide.

BRIEF DESCRIPTION OF THE INVENTION

Figure 2:
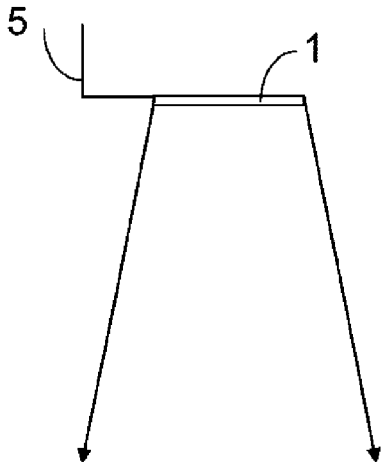
Figure 3:
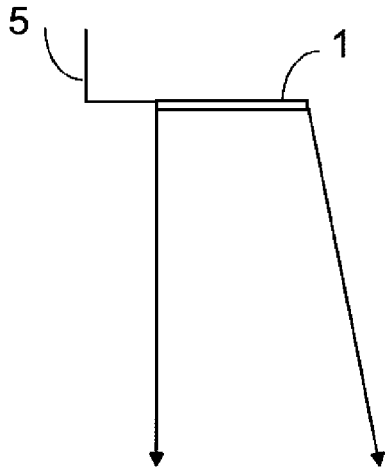
Figure 4:
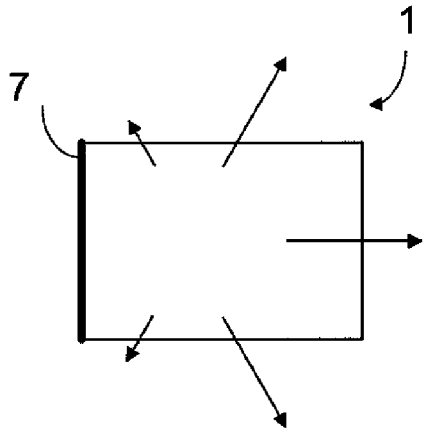
Figure 5:
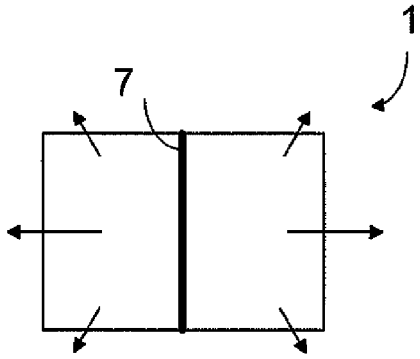
Figure 6:
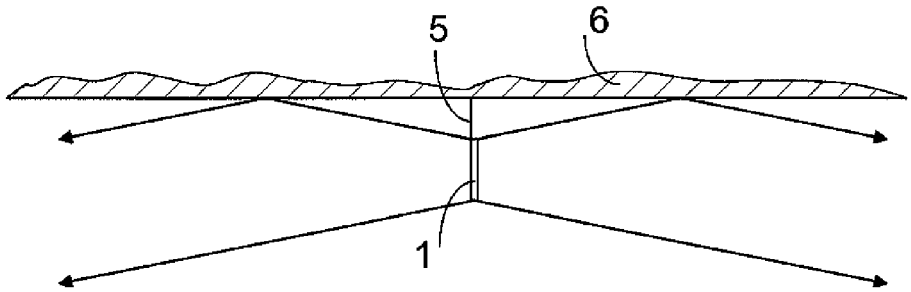
Figure 7:
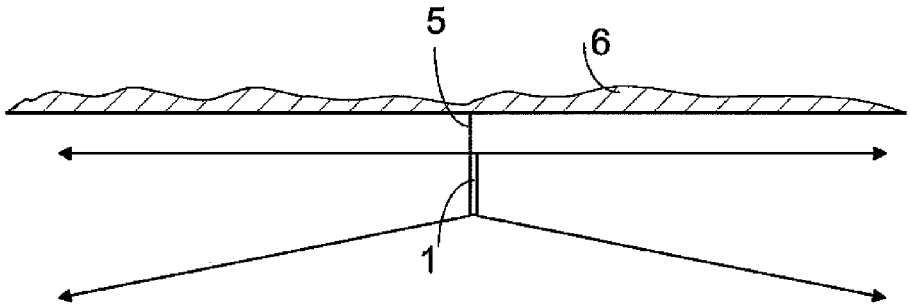

Some embodiments of the invention are described in more detail in the attached drawings, in which FIG. 1 is a schematic representation of the structure of an electrostatic actuator, such as loudspeaker, FIG. 2 is a schematic representation of a sound field formed by a prior-art electrostatic actuator, FIG. 3 is a schematic side view of a directed sound field formed using an electrostatic actuator of the invention, FIG. 4 is a schematic front view of the directed sound field formed using the electrostatic actuator of the invention shown in FIG. 3, FIG. 5 is a schematic front view of a sound field that is directed with an embodiment of an electrostatic actuator of the invention, in which the input site of the signal is on the midline of the actuator, FIG. 6 is a schematic representation of a sound field of a prior-art dipole actuator hung close to the ceiling of a passageway, and FIG. 7 is a schematic representation of a sound field of a dipole actuator of the invention hung close to the ceiling of a passageway.

In the figures, some embodiments of the invention are shown simplified for the sake of clarity. Similar parts are marked with the same reference numbers in the figures.

DETAILED DESCRIPTION OF THE INVENTION

FIG. 1 is a schematic representation of the structure of an electrostatic actuator, such as loudspeaker. The electrostatic actuator 1 comprises at least one plate-like stator 2 and a moving diaphragm 3. In the embodiment of FIG. 1, there are two stators 2, and the moving diaphragm 3 is arranged between the stators. Electrodes 4 are formed on the surface of the stators 2. Signals are transmitted to the electrodes along a signal line 5.

FIG. 2 shows a sound field formed by a prior-art electrostatic actuator. In the prior-art solution, the electrode 4 conducts electricity extremely well, that is, the surface 4 of the stator 2 is metal-coated, for instance, to be electrically conductive. A signal then does not, in practice, have a propagation time delay in the electrostatic actuator even though it is inputted on the edge of the actuator. The sound field then becomes as shown in FIG. 2.

FIGS. 3 and 4 are schematic representations of a directed sound field formed using an electrostatic actuator of the invention, when a signal is inputted on the left edge of the actuator 1. FIG. 3 is a side view of the sound field of the embodiment, and FIG. 4 is a front view of the sound field. The sound field then opens and turns more to the right. In other embodiments, a signal may, if required, also be inputted at some other point of the actuator, whereby the location of the connecting point in the actuator affects the values of the RC circuit and the shape of the radiation field, of which examples are shown in FIGS. 4 and 5.

In the solution of the invention, the directivity of a sound field is based on forming the delay directing the sound field with an RC circuit that is at least partly composed of components of the electrostatic actuator 1. The electrostatic actuator 1 itself serves as the capacitor of the RC circuit, because the stators 2 are so close to each other, preferably less than 1 mm apart, especially preferably less than 0.5 mm apart, that the capacitance of the electrostatic actuator 1 is quite high. In embodiments of the invention with only one stator, the capacitance is formed between the stator and diaphragm. The distance between the stator and diaphragm in a one-stator embodiment is preferably less than 0.5 mm.

The resistor of the RC circuit is in turn formed by making the electrode 4, that is, the surface of the stator 2, of a somewhat resistive material in such a manner that the resistance measured from the stator surface between the connecting point and the point of the same surface furthest away from it is at least 1 kΩ. The size of the actuators and naturally also the distances between the connecting points and the most distant point may vary in the embodiments from one centimetre to several metres, for instance. Because the forming capacitance may be adjusted in the manufacturing process, the desired specific resistance of the stator surface may extend on a wide area be $1*10^{-7}$-$1*10^{5}$ Ω*m, for example. The resistive material of the stator surface may then be formed of chromium, titan, stainless steel, or an electroconductive or semiconductive polymer, for instance, thus enabling several manufacturing methods. The capacitance and resistance and consequently also delay of the circuit may be adjusted even during the final manufacturing process, since the internal shapes of the electrostatic element affect the capacitance, and the resistance may also be adjusted by the selection of the length and location of the electric conductor. In addition, it is possible to add to the circuit separate resistors, capacitors, coils, and other corresponding components as desired.

Contrary to the prior-art solution, in the solution of the invention, the stator surface 4 is thus somewhat resistive, which is why differing from the prior-art solution, the delay of the signal increases in relation to the distance of the signal from its input site. Therefore, when the signal is inputted on the edge of the actuator 1 and the electrode 4 forms the RC circuit together with the actuator, the audio signal from a location further away from the signal input site 7 is delayed more than from a location closer to the signal input site 7; in the embodiment of FIG. 3, the signal on the opposite edge to the signal input site 7 is thus delayed, and the actuator 1 produces the directed sound field according to FIG. 3. The signal input site 7 is the point from which the signal is inputted to the actuator. The terms connecting point or connector may also be used to refer to the connecting site 7, as well as the term input point when referring specifically to a point-like input site.

Directing a sound field solely or primarily with actuator components reduces the number of required components and simplifies both structure and control. This is possible, because the static surfaces are very close to each other, which is why the capacitance of the actuator is high contrary to conventional solutions in which the static surfaces are distant from each other. When the capacitance is low, as is the case in the conventional solutions, the resistance needs to be high to obtain a corresponding time delay. In addition, due to a sufficiently high actuator capacitance, time delays required to direct a sound field are achieved already with electrode resistance values that do not weaken the sound quality, width of the frequency band, or energy efficiency to a significant extent.

FIG. 5 is a schematic representation of an example illustrating the changing of the directivity of a sound field in comparison with the sound field shown in FIG. 4 in a second embodiment of the invention, when the signal input site 7 is altered. In this embodiment, the input site 7 is on the midline of the actuator 1, whereby the sound field opens more to the sides than upward and downward.

One embodiment of the invention is illustrated in FIGS. 6 and 7, which show schematically a dipole actuator 1 that is hung close to the ceiling 6 of a passageway and radiates sound into two different directions. The signals are brought to the electrodes along a signal line 5. FIG. 6 shows a prior-art sound field that partly hits the ceiling 6 and thus incurs interfering reflections. FIG. 7 in turn shows a sound field in which the actuator 1 is made sound-directing in accordance with the invention in such a manner that the sound field is directed away from the input edge of the signal. This way, the arrangement of FIG. 7 is capable of avoiding the interfering reflection from the ceiling 6. This is especially advantageous in acoustically demanding locations, such as passageways and tunnels, as well as stores, shopping centres, and airports.

In different embodiments of the invention, the radiation field may also be expanded and directed into another direction than the normal of the radiation surface as desired. In addition, it is possible to produce separate sound fields by using two or more actuator or loudspeaker elements. These separate sound fields may, depending on their purpose, be summed into different directivity fields, they may be directed to the same target or to several different targets. This way, for instance flat loudspeakers that transmit a wave front generally perpendicular to the amplification surface may create sound field of very different types. Further, by combining the directivity of a sound field obtained by a delay and the bending of the element in the direction of the time delay, for example, or perpendicular to it and/or to the arrangement of the elements into groups in parallel or series, the listening area and directivity of the sound field and the sound environments obtained thereby may be adjusted in an even more versatile manner.

The actuator of the invention is especially useful in applications where the location of the actuator cannot be made optimal in relation to the listeners or the position of the actuator needs to be defined on manufacturing-engineering or visual grounds. An example of such an embodiment is a projection surface that also needs to serve as a loudspeaker. The surface has to be straight, but the sound radiation pattern may need to open asymmetrically. An optimally active surface area is also large, but the narrow radiation beam resulting from it needs to be expanded to suit a wider listening area. Another working example is loudspeakers in cars. Their optimal positioning and directing is often not possible, in which case the optimisation of the radiation beam with an actuator of the invention improves the experienced sound quality and system usability. A third example is headsets in which the actuator of the invention may achieve exactly regulated sound field properties close to the ear and outer auditory canal.

Further, in an embodiment of the invention, it is possible to form a spherical radiator for acoustic measurements. In this embodiment, by utilising the solution of the invention it is possible to form a polyhedron made of planes, whose radiation field properties may be balanced electrically without using multi-channel technology. This type of radiator is easier to manufacture than solutions based on the prior art, and acoustically it resembles a spherical radiator more closely.

In addition to the above-mentioned embodiments, the invention may also be utilised as various applications by utilising a direct or reflected sound field in other acoustic measuring devices and home sound reproduction equipment, multi-channel loudspeakers, and other vehicle loudspeakers. It is also possible to utilise loudspeaker elements as sound sensors (microphones), if desired.

In some cases the features presented in this application may be used as such regardless of other features. On the other hand, the features presented in this application may, if necessary, be combined to form various combinations.

The drawings and the related description are only intended to illustrate the idea of the invention. The invention may vary in detail within the scope of the claims.

The invention claimed is:

1. A plate-like electrostatic actuator that is arranged close to a ceiling and has:

a signal input site that is on an edge of the actuator, at least one plate-like stator that has a stator surface and an electrode that is formed on the stator surface and receives a sound signal from a signal line, at least one moving diaphragm, that creates a sound field, and an RC circuit that has a resistor that directs the sound field, wherein:

the resistor is at least partly formed by making the stator surface that forms the electrode from a material that is resistive enough to delay the sound signal from a location away from the signal input site sufficiently more than from a location closer to the signal input site so that the resulting sound field is a plane waveform sound field that is turned away from the ceiling.

2. An actuator as claimed in claim 1, wherein the resistance measured from the stator surface between the input site and the point of the same surface furthest away from it is at least 1 kΩ.

3. An actuator as claimed in claim 1, wherein the electrostatic actuator as such acts at least partly as the capacitor of the RC circuit.

4. An actuator as claimed in claim 1, wherein the actuator comprises two plate-like stators and a moving diaphragm arranged between them.

5. An actuator as claimed in claim 4, wherein the distance between the stators of the electrostatic actuator acting as the capacitor of the RC circuit is less than 1.0 mm.

6. An actuator as claimed in claim 1, wherein the distance between the plate-like stator and moving diaphragm of the electrostatic actuator serves at least partly as the capacitor of a one-stator RC circuit, and the distance is less than 0.5 mm.

7. An actuator as claimed in claim 1, wherein the actuator is a loudspeaker.

8. An actuator as claimed in claim 1, wherein the actuator is a microphone.

9. A method for directing the sound field of a plate-like electrostatic actuator that comprises (a) a signal input site on an edge of the actuator, (b) at least one plate-like stator that has an electrode that is formed on its surface, and (c) at least one moving diaphragm, the method comprising the steps of:

transmitting a signal to the electrode along a signal line; and providing directivity by using an RC circuit that is at least partly composed of components of the actuator to delay a sound signal from a location away from the signal input site sufficiently more than from a location closer to the signal input site so that a resulting sound field is turned in plane waveform.

10. A method as claimed in claim 9, wherein the resistance measured from the stator surface between the signal input site and the point of the same surface furthest away from the signal input site is at least 1 kΩ.

11. A method as claimed in claim 9, wherein the electrostatic actuator as such acts at least partly as the capacitor of the RC circuit.

12. A method as claimed in claim 9, wherein the actuator comprises two plate-like stators and a moving diaphragm arranged between them.

* * * * *